US005370052A

United States Patent [19]

Reslow

[11] Patent Number: 5,370,052

[45] Date of Patent: Dec. 6, 1994

[54] METHOD OF CONTROLLING THE QUANTITY OF PRINTING INK AND RECONDITIONING USED ANILOX ROLLERS

[75] Inventor: Leif F. Reslow, E. Greenwich, R.I.

[73] Assignee: MAN Roland Druckmaschinen AG, Offenbach am Main, Germany

[21] Appl. No.: 31,643

[22] Filed: Mar. 15, 1993

[51] Int. Cl.[5] ..... B41F 31/26

[52] U.S. Cl. ..... 101/483; 101/401.1

[58] Field of Search ..... 101/363, 348, 350, 364, 101/207, 208–210, 401.1, 170, 157, 169, 148, 395, 484, 483; 492/30, 32, 37, 53, 54

[56] References Cited

U.S. PATENT DOCUMENTS

| | | | |
|---|---|---|---|
| 3,589,289 | 6/1971 | Ironbequoit | 101/401.1 |
| 4,993,320 | 2/9191 | Kochsmeier | 101/148 |
| 5,072,671 | 12/1991 | Schneider et al. | 101/401.1 |
| 5,191,703 | 3/1993 | John . | |

FOREIGN PATENT DOCUMENTS

| | | |
|---|---|---|
| 3022692 | 1/1990 | Germany . |
| 3903372 | 8/1990 | Germany . |

*Primary Examiner*—J. Reed Fisher
*Attorney, Agent, or Firm*—Frishauf, Holtz, Goodman & Woodward

[57] ABSTRACT

To maintain required or desired ink transfer capability of an anilox roller (6) after wear and tear caused, for example, upon engagement of the surface of the roller against a doctor blade (*7a*, *7b*) of a chambered inking unit (7), the ink receptor depressions or cells (14, 514) in the surface of the roller are formed with a depth which is substantially greater than that necessary for the volumetric dimension for required or desired retention of ink suitable for transfer upon printing with a predetermined print density. Before application of printing ink thereto, the cells are filled with a removable filler material (20), for example copper, plastics such as polyethylene, epoxy, wax or the like. After the surface of the strips or ridges or cell walls becomes worn, a portion of the filler material is removed, for example by vaporization, by a laser, etching or the like, to reconstitute the original volume for ink retention. The change in print density upon printing, as the surface wears, is abrupt (FIG. 4 : tB) and, when that change is determined, the volume-reconstituting step is carried out. If the surface of the roller itself is a layer which is readily machinable, for example made of copper, the initial depth of the cells (14, 514) may be for the initial requirement of ink retention. The layer thickness is then originally made thick enough so that, upon sensing of the abrupt change in print density, for example based on time or on printing results, the depth of the cells still present in the roller can be increased, e.g. by a laser, to obtain and reconstitute the volumetric dimension for desired ink retention.

18 Claims, 3 Drawing Sheets

METHOD OF CONTROLLING THE QUANTITY OF PRINTING INK AND RECONDITIONING USED ANILOX ROLLERS

Reference to related patents, assigned to the assignee of the present application, the disclosure of which is hereby incorporated by reference:

U.S. Pat. No. 5,072,671, Schneider et al

U.S. Pat. No. 5,072,671, John (based on Ser. No. 07/762,582, filed Sep. 19, 1991).

Reference to related disclosure, assigned to the assignee of the present application:

German Gebrauchsmuster (Utility Model) G 88 09 259.

Reference to related publications:

German Patent 38 22 692 and its patent of addition:

U.S. Pat. No. 4,993,320, which includes the disclosure of

German Patent 39 03 372, Kochsmeier;

German Patent 37 13 027, Herb.

FIELD OF THE INVENTION

The present invention relates to printing machinery, and more particularly to a screened or engraved roller, such as an anilox roller, which has depressions or cells, and especially to a method of controlling the volume of the cells for acceptance of ink in accordance with desired quantities, and reconditioning a used anilox roller upon change of cells size due to wear and tear on the roller, in operation.

BACKGROUND

Cellular ink transfer rollers, for example anilox rollers, usually have a base body, for example of steel, which may be supplied with shaft extensions for holding the roller in suitable bearings, coupling to drive wheels or gears, or the like. The steel body may have the cells or depressions engraved therein; it is customary, however, to apply a layer of engravable material on the steel body and to form the depressions therein, leaving ribs or ridges or webs projecting from the walls of the cells between the cells themselves, which may be of wear-resistant material. Ink is supplied to anilox rollers frequently from chambered ink supply units, supplied at an upper and a lower side of the chamber with doctor blades, which wipe and rub against the outer surface of the thus formed cellular roller. The referenced U.S. Pat. No. 5,191,703, John, based on U.S. Ser. 07/762,582, filed Sep. 19, 1991 describes a roller in which hard ridges or ribs of chromium dioxide, aluminum oxide ceramic or the like, form the outer surface region of the anilox roller. The cells themselves are formed in a softer material between the ribs, for example copper.

The quantity of ink which can be accepted by the cells depends greatly on the depth of the cells, that is, the depth dimension from the outermost surface of the anilox roller. This dimension which is normally determined by the projection of the ribs or ridges above the lowermost point of the cells. A common concept is the ink transfer number. This ink transfer number is defined as the quantity of ink, in cubic centimeters, per square meter of surface of the anilox roller. Theoretically, the ink transfer number should correspond to the total volume of the cells, in cubic centimeters per square meter of the anilox roller. Actually, the ink transferred is somewhat less since somewhat less ink is removed from the cells during printing than theoretically possible.

It has been found that, in operation, the surface changes due to wear of the ribs and walls of the cells which, in turn, changes the volume of the cells. The volume will decrease as the ribs or ridges between the cells are worn away by the engagement with the doctor blades, during printing. Thus, the ink transfer number changes. This is undesirable in printing operations resulting in loss of ink density.

THE INVENTION

It is an object to provide a method of accurately setting a desired or commanded ink transfer number when manufacturing the cells of a cellular roller and further to permit reconstituting of the desired ink transfer number, or the cell volume, after the cellular roller has been in use for some time; and to determine when the cell volume should be reconstituted.

Briefly, the ink receptor depressions or cells are formed in a surface of a cellular roller to have a depth such that the volume of the receptors or cells is substantially larger than that which is required for retention of ink suitable for transfer upon printing, that is, substantially larger than that corresponding to an ink transfer number which is desired for printing; these much larger receptor depressions or cells are then partially filled with a filler material to reduce the volume of the cells to a volumetric extent required for retention of the desired quantity of ink suitable for printing, that is, to have the ink transfer number which is intended. After operation of the anilox roller in a printing machine, with consequent wear and decrease of the radial extent of the cells walls, strips or ridges between the cells, resulting in a decrease of the volume dimension of the receptors or cells, the extent of decrease is determined and, when the decrease abruptly becomes large, thus resulting in an abrupt change of the volume dimension to a lesser value, a quantity of the filler material in the cells is removed, thereby reconstituting the desired value of the ink transfer number and/or of the volumetric dimension of the cells.

The concept thus is somewhat analogous to lacquering a gravure cylinder—albeit with excessively deep cells—and then, when the surface of the cylinder has worn away, removing material when additional cell volume is needed.

The depth of the cells to accept ink for printing, that is, for desired or commanded ink transfer numbers is very small, for example for water-based inks in the order of between about 0.01 to 0.02 mm; for offset use, they may be deeper, e.g. 0.02 mm to 0.05 mm. In accordance with a feature of the invention, this depth is substantially increased, for example to a depth of between about 0.04 mm to 0.06 mm for flexography; for offset, e.g. 0.08 to 0.15 mm. Before the cellular roller is first placed in operation, the cells are filled with the filler material to have the initially desired depth for the selected ink transfer number. Suitable filler materials are vaporizable materials such as plastics or wax; or other materials which can be readily applied and removed, for example copper. Suitable ways of removing the filler materials are, for example, with a laser or by etching. The particular form of removal of the filler material to reconstitute the ink transfer number will depend on the type and composition of the filler material being used.

Some filler materials can be easily removed in their entirety, for example vaporized with a laser. Such filler materials may be plastics such as polyamide-11, a type of nylon; epoxy, asphalt, or polyethylene. Particularly when using such materials, then, in accordance with a feature of the invention, a method of reconstituting the cells with the desired ink transfer number, after use, can include removal of all filler material from the cells, for example by vaporization, washing out with a suitable solvent or the like, and then refilling the cells with a smaller quantity of filler material than used during the first filling step, but enough to reconstitute the desired ink transfer number. This operation can be carried out repeatedly, thus permitting long use of the basic anilox roller structure, that is, the steel cylinder with a surface in which cells have been formed, separated by ridges or ribs which are subject to wear. The ridges or ribs may be of hard, wear-resistant material, see for example U.S. Pat. No. 5,191,703 John (Ser. No. 07/762,582).

DRAWINGS

Figure 2:
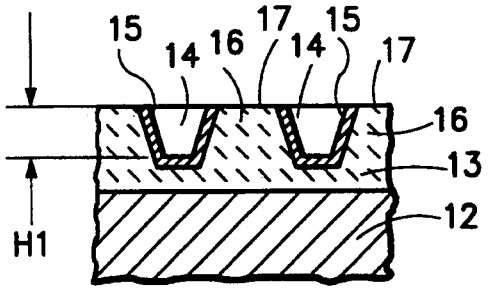
FIG. 2 is a schematic fragmentary cross-sectional view through a portion of the surface of the cellular roller.
Figure 3A:
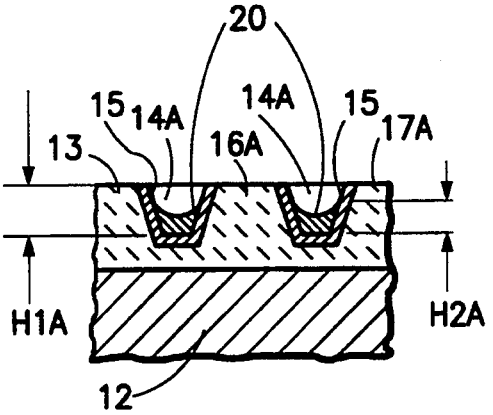
FIGS. 3A, 3B and 3C are views similar to FIG. 2, to a somewhat enlarged scale, and illustrating consecutive steps in carrying out the method in accordance with the present invention as the cellular roller, in use, wears.
Figure 3B:
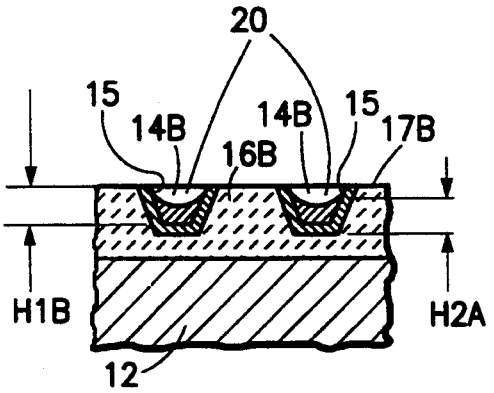
Figure 3C:
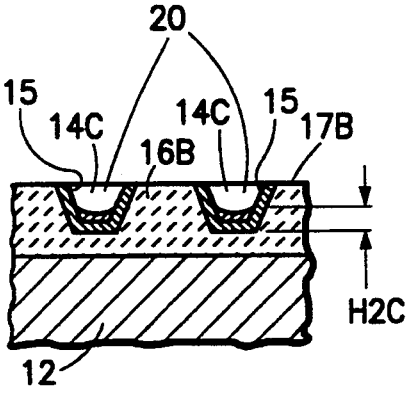
Figure 4:
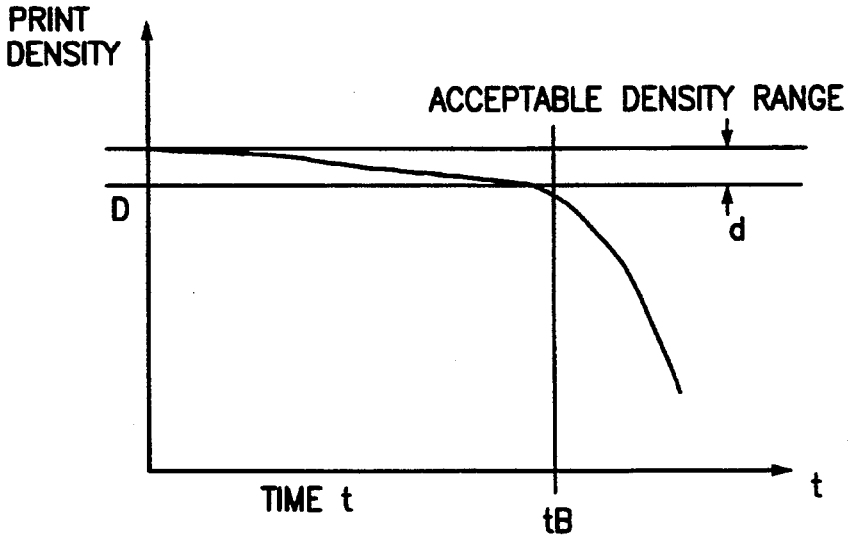
Figure 5:
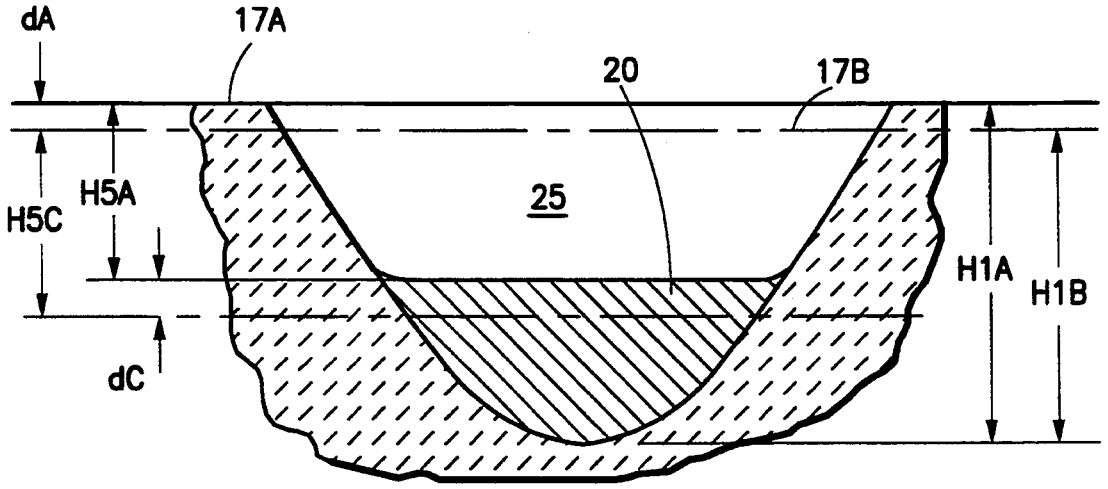

FIG. 4 is a highly schematic diagram of cell volume V (ordinate) with respect to operating time t (abscissa) of a cellular roller; and FIG. 5 is a highly enlarged cross-sectional view of a single cell having a somewhat different shape from that shown in FIGS. 2 and 3 (collectively) and illustrating, in detail, height dimensions of the cell, before and after the roller has been in operation in the printing machine.

DETAILED DESCRIPTION

Figure 1:
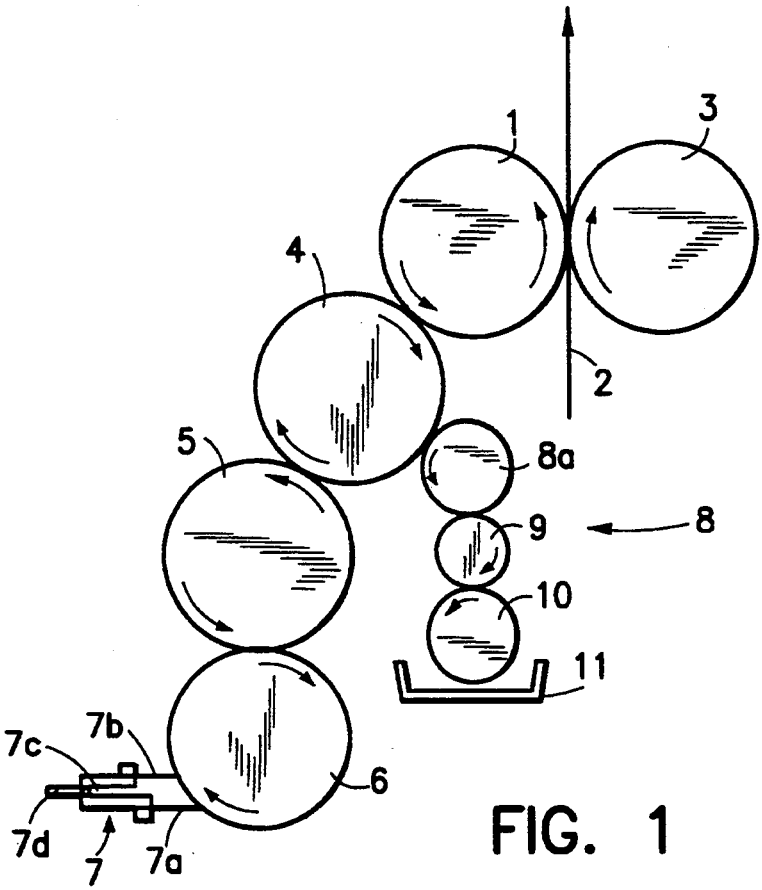
FIG. 1 is a highly schematic side view of an offset printing system having a cellular ink roller.
Figure 1A:
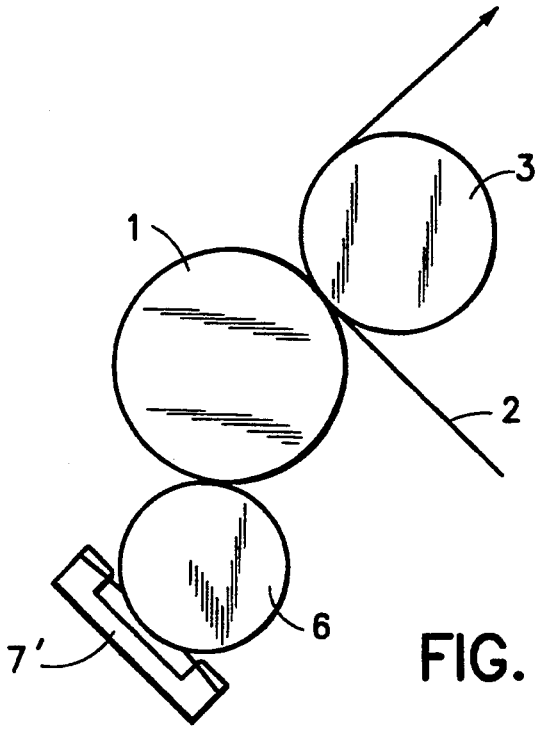
FIG. 1A is a highly schematic side view of a flexographic printing machine.

Referring first to FIGS. 1 and 2:

The printing machine system includes a rubber blanket or offset cylinder 1 for printing on the substrate 2. The substrate 2 is guided between the offset cylinder 1 and an impression cylinder 3 which, for example, may be a blanket or offset cylinder of another printing system. A plate cylinder 4 applies printed subject matter on the offset cylinder 3. Ink is applied to the plate cylinder 4 by an inker having an ink application cylinder 5, which receives ink from a cellular roller 6, to which ink is applied by a chambered ink supply unit 7. The chambered ink supply unit has an ink application chamber **7*c*, and two doctor blades 7*a*, 7*b* confining the ink within the chamber 7*c*, but permitting application of the ink against the celluar roller 6. The chambered ink supply unit 7 receives ink from an ink supply through an ink supply duct 7*d*. The ink supply forms no part of the present invention and, therefore, has been omitted from the drawing. It may be of any suitable and well-known construction, for example including a pump to supply ink to the chamber 7*c*. A dampener 8, having a dampening liquid trough 11, a dampening liquid cylinder, a transfer cylinder 9 and an application roller 8*a* is engaged against the plate cylinder 4 to apply dampening liquid, for example a watery liquid, to the plate cylinder 4. The cylinders rotate in the directions of the arrows shown in FIG. 1**.

In flexographic printing, the anilox cylinder or roller 6 directly applies ink to the plate cylinder 4. An inker, shown schematically at 7', inks roller 6.

A surface portion of the cellular roller 6 is seen in detail in FIG. 2. The roller 6 is formed by a metallic base body 12, preferably of steel. A ceramic layer 13 is applied to the base body 12, in which cells 14 are formed. The inner wall of the cells are coated or supplied with a layer 15 of copper to render them hydrophobic or oleophilic, that is, capable of accepting and retaining ink. The layer 15 can be applied by various processes, for example by vapor deposition. Ridges or strips 16 will remain between the walls of the cells 14. The outer surface of these ridges or strips, shown at 17 in FIG. 2, will define the outer surface of the cellular roller 6. It is preferably ground for exact centricity with respect to retaining shafts formed on the roller 6, and may be polished or lapped. The hard ceramic material 13 can be applied to the steel core 12, for example by spraying.

Formation of the cells 14 can be carried out in various ways, for example by a laser beam; alternatively, the cells 14 can be formed as described in the aforementioned U.S. Pat. No. 5,191,703, John (based on application Ser. No. 07/762,582).

The doctor blades **7*a*, 7*b* (FIG. 1) ride on the surfaces 17 of the ribs or ridges 16. In use, the doctor blades which customarily are made of hardened steel and readily replaced, will wear down the outer surface of the cellular roller 6, that is, will wear down the surfaces 17. This decreases the radial dimension of roller 6** to a minute extent which, in operation of the printing machine, can be neglected.

In order to provide a desired ink transfer number, the cells are formed to have a predetermined volume. The cells, usually, are not cylindrical but may be shaped as shown in FIG. 2 or in FIG. 5, respectively. Initially, the cells are formed with a depth H1, see FIGS. 2 and 3 (collectively). FIG. 3A shows the initial depth of the cell 14A to be H1A, formed in the layer 13 of highly abrasion-resistant material, leaving a rib 16A between the walls of the cells. As the doctor blades, in use of the printing machine, slide over the surfaces 17A, they will wear down these surfaces, so that the depth of the cells will change from the dimension H1A to the dimension H1B, since the ribs or ridges and cell walls have been worn down as seen at 16B.

In accordance with a feature of the invention, the cells 14A are filled essentially uniformly with a filler material 20 to a depth H2A. The volume of the cell which is capable of accepting ink, thus, will be less than the volume of the cell 14A, engraved or otherwise formed in the layer 13. As can be readily seen by comparing FIGS. 3A and 3B, this volume has changed after wear of the roller. The cells 14B between the ridges 16B are now much smaller. Consequently, the quantity of ink which can be accepted by the remaining space in the cells 14B is less than that of the cells of FIG. 3A. This has, therefore, changed the ink transfer number of the roller.

In accordance with a feature of the invention, the original ink transfer number can be reconstituted, as schematically shown in FIG. 3C, by reducing the level of the filler material 20 to the level H2C. The ink transfer number of the cellular roller with the cells 14C, therefore, can be the same as that of the original, for example new cellular roller shown in FIG. 3A.

The change in level of the filler material 20 can be done in various ways, for example by entirely removing the filler material 20 from the cells 14B, and refilling the cells with filler material to the level H2C; or by selectively removing just so much filler material 20 from the cells shown in FIG. 3B to leave only that much shown in FIG. 3C. Removal can be done, for example, by impinging a laser beam against the cells to vaporize, melt, or otherwise remove the filler material; by etching or by any other suitable removal means. Since the cells are very small, accurate control of a removal tool is required. A laser is highly useful and for many applications is a preferred removal tool. The thickness of the layer 13, originally, should preferably be about at least three times the maximum depth of the cells 14A to leave a base on the core 12. The cells are deep enough before the cellular roller is worn, to permit partial filling of the cells, and then lowering the level of the filler, for example from the dimension H2A to the dimension H2C. This partial lowering may be carried out several times, until the roller is worn to such an extent that no fill is left in the bottom of the cells.

The change in level of the fill, as the dimension H1 (FIG. 2) changes, which, of course, also corresponds to a change in the radial dimension of the roller 6, is best seen by reference to FIG. 5, in which a cell having a somewhat negative sine-wave cross section is shown. The original height dimension of the cell 514 is shown at H1A, as in FIG. 3A. After wear, the cell 514 will have a height dimension H1B, in analogy to FIG. 3B. To maintain the volumetric dimension 25 to accept ink in the cell at a constant suitable or designed level, even if the height dimension of the cell changes from H1A to H1B, it is necessary to drop the level of the filler material 20 from the indicated prior level H5A to the new level H5C from the surface 17B. As can be readily seen by comparing the distance dA between the level line 17A, 17B with the distance dC in FIG. 5, it is necessary to drop the level of the filler material 20 to a greater extent than the wear dA of the ridges or ribs 17. Of course, the volume of removed material should correspond to the volume of the cells between the outer surface level lines 17A and 17B. The relationship is non-linear due to the non-cylindrical shape of the usual cells. It has been found, surprisingly, that the drop in the ink transfer number and, thus, of the volume of the cells with respect to operating time, is quite abrupt. FIG. 4 illustrates a curve, derived from experience after this discovery, of change of print density D (ordinate) with respect to operating time, e.g. running hours of the roller, shown on the abscissa. Loss of volume of the cells during operation of the machine is non-linear with respect to operating time. The real change in the performance is the combination of volume loss and transfer efficiency. Transfer efficiency is affected by surface tension of the liquid, that is, of the ink, and the surface area of the cell as compared to the remaining volume. This relationship is expressed in a curve, shown in FIG. 4; it has not been mathematically described, but is an observation fairly consistent across the industry. The acceptable range of variation of print density is shown at d. At a certain operating time, tB, there is an abrupt drop in the volume available for ink transfer and hence of print density, and also of the ink transfer number. This drop can be established by experience or by sensing that inking is getting faint, i.e. that the print density has exceeded the acceptable range d. Upon sensing that the ink transfer number, and hence the volume and print density has changed, or after a given operating time, based on experience, the step of reconstituting the volume of the cells, by removal of previously deposited filler material, is carried out.

The knee in the volume-vs.--operating time diagram can be readily observed by loss of density of printing.

The construction of the anilox roller 6, itself, can be conventional; preferably, it uses a steel core 12, with a coating which may be copper, nickel, asphalt, or a suitable plastic such as polyamide-11 or the like. In a preferred form, the cells themselves are formed in a ceramic layer previously applied to the steel core. Suitable ceramics are, for example chromium oxide ($Cr_2O_3$) ceramic, aluminum oxide or the like. The cells are preferably coated at the sides with copper or any other suitable oleophilic material, and then supplied with the fillers described. The reduction in filler material, by a laser, by etching or the like, is carried out when the knee of the curve (FIG. 4) is determined at the point tB. At that time, the filler material 20 or a portion thereof is ablated, for example by vaporization, erosion or etching, until the volumetric dimension 25, required for retention of ink suitable for printing, and obtaining the desired ink transfer number, is achieved.

Sometimes, a nickel flashing on the steel core is desirable to reduce corrosion before the ceramic is applied. The laser can then engrave the ceramic directly. There is usually a post-engraving step where the cylinder is diamond polished to remove the recast of the ceramic around the cell.

It is not necessary that the cellular roller carries, initially, a highly wear-resistant layer on the steel core 12. For example, it may have a copper jacket or layer formed therearound, in which, in accordance with a feature of the present invention, the cells are formed but—and in contrast to the prior art—with a depth dimension H1A (FIG. 5) substantially greater than that required to achieve the desired ink transfer number. The fillers 20 are filled in these cells, as described in connection with FIGS. 3 and 5.

As yet another alternative, initially the cells, when formed in a surface layer or sleeve, may have the depth dimension H1 corresponding to the desired ink transfer number, without any filler; then, when the knee tB of the curve in FIG. 4 is determined, the cells formed in the surface are extended in depth to reconstitute a new depth so that the volume of the cells will be reconstituted to the desired ink transfer number. This requires an initially thicker jacket than used heretofore, i.e. a thickness of a multiple of the depth of the cells, plus an underlying base against the steel core.

In one embodiment for flexography, a steel core 12 was used which had a diameter, arbitrarily selected, of 25 cm. A jacket or layer 13 of ceramic material was applied, having a thickness of between 0.25 to 0.55 mm. The cells 14 or 514, initially, can have a depth dimension of between about 0.04 to 0.06 mm. The cells can be reconstituted or extended into the jacket or layer 13 after the roller has worn down in operation, for example two times before a new jacket with a new cell structure has to be applied.

Insertion of filler 20 into the cells 14 can be done, for example, by a thermo transfer process in which a carrier layer, having applied thereto a relatively thick coating of filler material, is placed against the surface of the cellular roller, with the cells 14 therein. The carrier layer is heated, and the filler material, for example wax, polyethelyne or the like, will melt, and deposit in the cells 14, to fill them partially—see FIG. 3A, for example. After the cellular roller has been used and is worn (FIG. 3B), the material can be removed readily in its entirety, for example by washing with a suitable solvent, mechanical removal by spraying with a high-intensity jet stream, chemicals which dissolve the filler material or the like; thereafter, a second, and smaller deposit of filler material can be applied. Application of the second layer can be done in the same way as application of the first way, by using a thermo transfer foil, however with a thinner transfer material coating which will then melt-deposit itself in the cells, see FIG. 3C. If such thermo transfer foils are supplied with a continuous layer of filler material, in which only the regions immediately opposite the cells 14 are to be used for the fill, it is possible that adjacent regions of depositable, meltable material will adhere to the surface regions 17. They can be readily removed, for example by grinding off, or scraping off the additional material from the surface regions 17.

Deepening already existing cells, for example after wear and tear, can be carried out, preferably, by laser application. The time of operation tB when such procedures are necessary can be easily determined by a few experiments. This time depends on the resistance to abrasion of the outer surface of the cellular roller, the material of the doctor blades *7a*, *7b*, the engagement pressure of the doctor blades and the like. If copper is used as the outer material surrounding a core of steel, a layer of chromium on the copper can be applied, which can also form the inner liner 15 of the cells, into which filler material, for example wax or the like is placed. Application of meltable material from a foil is well known; the referenced U.S. Pat. No. 5,072,671, Schneider et al, assigned to the assignee of the present application, provides an example.

The filler material may also be a lacquer similar to lacquers used to reduce cell depth in gravure printing. The filler material additionally should be effectively insoluble by the ink which is used, and the solvents for the ink, yet be ink attracting or accepting. Since water is used as a solvent in flexo printing, the fill for the rollers intended for flexo printing must be insoluble in water.

Various changes and modifications may be made, and any features described herein may be used with any of the others, within the scope of the inventive concept.

I claim:

1. A method of controlling the quantity of printing ink available for transfer from a cellular roller (6) to plate cylinder (4) carrying an image to be printed, wherein the surface of the cellular roller (6) is formed with ink receptor depressions or cells (14) while leaving cell walls, strips or ridges (16) between the cells, said cell walls, strips or ridges defining surface regions (17), and wherein the cellular roller (16), in use, is engaged against at least one doctor blade (*7a*, *7b*) which causes surface wear or surface ablation or abrasion of the surface regions (17) of the cellular roller, said method comprising the steps of forming the ink receptor depressions or cells (14) in the surface of a roller core or body (12, 13) with a depth (H1), measured radially from the outer surface region (17) of the cell walls, strips or ridges (16) such that the volume of the receptors or cells (14) is substantially larger than the volumetric dimension (25) which is required for retention of ink in a quantity suitable or desired for transfer to the plate cylinder (4) upon printing;

essentially uniformly partially filling the receptors or cells (14, 514) with a filler material (20) to reduce the volume of the cells to a volumetric dimension required for retention of ink in the quantity suitable or desired for printing on the plate cylinder (4), and thereby forming said cellular roller (6);

filling the receptors or cells (14, 514) with the suitable or desired quantity of ink and operating the roller (16) in a printing machine, transferring the ink to the plate cylinder; and after operation of the cellular roller in the printing machine, with consequent wear and decrease of the radial dimension of the roller core or body (12, 13) and of the outer extent of the cell walls, or strips or ridges (16), resulting in a decrease of the volumetric dimension of the receptors or cells (14, 514) which are partially filled with said filler material, removing at least part of the quantity of filler material in the ink receptor depressions or cells (14) to reconstitute the volumetric dimension required for retention of ink in said suitable or desired quantity for subsequent inking of the plate cylinder (4) in the printing machine upon operation of the cellular roller (6) in the printing machine.

2. The method of claim 1, wherein said removal of filler material is carried out by ablating at least a portion of the filler material within the cells.

3. The method of claim 2, wherein said step of ablating is carried out by etching.

4. The method of claim 2, wherein said step of ablating is carried out by applying a laser beam to the filler material and thereby removing at least said portion of the filler material.

5. The method of claim 1, wherein said step of removal of at least part of said filler material comprises removing all filler material (20) from the receptors or cells, after said volumetric dimension has decreased; and refilling said receptors or cells in a second filling step, in which the quantity of filler material filled in said second filling step is less than the amount originally filled into said cells and before said decrease in volumetric dimensions.

6. The method of claim 5, wherein said filler material is meltable and said step of removing the filler material from the cells comprises melting-out the filler material from the cells.

7. The method of claim 5, wherein said filler material is soluble and said step of removing the filler material comprises dissolving or washing out the filler material remaining in the cells prior to carrying out said step of refilling filler material to a lesser extent into said cells.

8. The method of claim 1, including, during the step of operating the roller in the printing machine, the step of determining the extent of print density after operation of the cellular roller and, when said density changes abruptly, due to decrease of the volumetric dimension (FIG. 4: tB) to a lesser value, initiating the step of removing at least part of the filler material to reconstitute the suitable and desired volumetric dimension.

9. The method of claim 1, wherein said filler material (20) is meltable.

10. The method of claim 1, wherein said filler material comprises copper, or plastics, optionally polyethylene, or 2-component adhesives, optionally epoxy.

11. The method of claim 1, wherein said filler material is oleophilic; and wherein said surface regions (17) are hydrophilic.

12. The method of claim 1, wherein the ribs, strips or ridges (16) formed with said surface regions (17) comprise wear-resistant material, optionally chromium oxide or aluminum oxide.

13. The method of claim 1, wherein the surface of the cellular roller (6) in which said ink receptor depressions or cells (14, 514) are formed comprises a ceramic.

14. The method of claim 1, wherein said cellular roller comprises a core (12) and a surface layer (13), said ink receptor depressions or cells (14, 514) being formed in said surface layer; and wherein said surface layer has a thickness which is at least three times, and optionally up to about ten times, the depth (H1) of the ink receptor depressions or cells which have the volume which is substantially larger than that which is required for retention of ink in a quantity suitable or desired for transfer upon printing.

15. The method of claim 14, wherein the surface of the cellular roller (6) in which said ink receptor depressions or cells (14, 514) are formed comprises a ceramic.

16. In a method to manufacture an inker for inking of a plate cylinder (4) in a printing machine, a method of making a cellular ink accepting and transfer roller (6), and for controlling the quantity of ink to be transferred from said roller to the plate cylinder (4), comprising providing a surface layer (13) on a roller core (12), to thereby provide a roller body;

forming ink receptor depressions, or cells (14, 514) in said surface layer (13), while leaving cell walls, strips or ridges (16) between the cells, said strips or ridges defining surface regions (17), and wherein the cellular roller (6), when in use in the printing machine to transfer ink to the plate cylinder (4), is engaged against at least one doctor blade (7*a*, 7*b*) which causes surface wear or surface ablation or abrasion of the surface regions of the roller core or body (12), said method comprising the steps of forming said surface layer (13) with a thickness which is a multiple of the depth dimensions of said cells plus an underlying layer abutting said core (12);

forming said ink receptor depressions or cells (14) with a depth dimension in said surface layer (13) such that the volumetric dimension of the receptors or cells corresponds to the volumetric dimension required for retention of ink suitable or desirable for transfer of ink to said plate cylinder upon printing at a predetermined print density;

filling the receptors or cells (14) with the suitable or desired quantity of ink for transfer of the ink to the plate cylinder (4) and operating the roller (6) in a printing machine;

after operation of the roller in the printing machine with consequent wear and decrease of the radial dimension of the roller (6) and of the outer extent of the cell walls, strips or ridges (16) resulting in decrease of the volumetric dimensions of the receptors or cells, determining the extent of decrease of print density and, when said decrease changes abruptly, as a result of change in said volumetric dimension, (FIG. 4: tB) to a lesser value, reconstituting said desired volumetric dimension by increasing the depth dimension of said cells (14) in the surface layer (13) of the cellular roller to reconstitute at least the depth dimension of the ink receptor depressions or cells (14) prior to said abrupt change in print density (tB), to result in the volumetric dimension of the receptor depressions or cells (14) to correspond to said required volumetric dimension of the receptor depressions or cells for printing on the plate cylinder (4).

17. The method of claim 16, wherein said step of reconstituting said desired or required volumetric dimension comprises re-dimensioning the cells (14) by application of laser radiation against the cells.

18. The method of claim 16, wherein said cellular roller comprises a roller core (12), optionally of steel; and a surface layer (13) thereon of surface-shapable material, optionally ceramic or copper, in which said cells (14, 514) are formed, and in which said receptor depression or cell forming, and subsequent re-forming steps are carried out.

* * * * *